US009103171B2

(12) United States Patent
Hanford

(10) Patent No.: US 9,103,171 B2
(45) Date of Patent: Aug. 11, 2015

(54) APPARATUS FOR CONTROLLING DRILL BIT DEPTH OF CUT USING THERMALLY EXPANDABLE MATERIALS

(75) Inventor: Ryan J. Hanford, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 520 days.

(21) Appl. No.: 13/435,097

(22) Filed: Mar. 30, 2012

(65) Prior Publication Data

US 2012/0255784 A1 Oct. 11, 2012

Related U.S. Application Data

(60) Provisional application No. 61/472,887, filed on Apr. 7, 2011.

(51) Int. Cl.
*E21B 10/62* (2006.01)
*E21B 10/54* (2006.01)

(52) U.S. Cl.
CPC ..... *E21B 10/54* (2013.01); *E21B 10/62* (2013.01)

(58) Field of Classification Search
CPC ..... E21B 10/54; E21B 10/62
USPC ..... 175/27, 39, 57, 425
See application file for complete search history.

(56) References Cited

U.S. PATENT DOCUMENTS

| | | | |
|---|---|---|---|
| 2008/0053705 | A1 | 3/2008 | Aronstam et al. |
| 2009/0065262 | A1 | 3/2009 | Downton et al. |
| 2010/0071956 | A1 | 3/2010 | Beuershausen |
| 2010/0071962 | A1 | 3/2010 | Beuershausen |
| 2011/0031025 | A1 | 2/2011 | Kulkarni et al. |

OTHER PUBLICATIONS

International Search Report and Written Opinion dated Oct. 29, 2012 for International Application No. PCT/US2012/032266.

*Primary Examiner* — Robert E Fuller
(74) *Attorney, Agent, or Firm* — Cantor Colburn LLP

(57) ABSTRACT

A drill bit for use in drilling a borehole is described that includes a body including a side, face section and a passage in the body. The drill bit further includes a rubbing member disposed in the face section and configured to control a depth of cut for the drill bit, wherein the rubbing member comprises a thermally responsive material in thermal communication with the passage configured to control a position of the rubbing member with respect to the face section.

19 Claims, 3 Drawing Sheets

APPARATUS FOR CONTROLLING DRILL BIT DEPTH OF CUT USING THERMALLY EXPANDABLE MATERIALS

CROSS-REFERENCE TO RELATED APPLICATIONS

This application takes priority from U.S. Provisional application Ser. No. 61/472,887, filed on Apr. 7, 2011, which is incorporated herein in its entirety by reference.

BACKGROUND OF THE DISCLOSURE

1. Field of the Disclosure

The disclosure relates generally to apparatus and methods for forming boreholes and, specifically, for controlling a depth of cut when drilling.

2. Description of the Related Art

To form a wellbore or borehole in a formation, a drilling assembly (also referred to as the "bottom hole assembly" or the "BHA") carrying a drill bit at its bottom end is conveyed downhole. The wellbore may be used to store fluids in the formation or obtain fluids from the formation, such as hydrocarbons. The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit is typically attached to the bottom end of the BHA. The drill bit is rotated by rotating the drill string and/or by a drilling motor (also referred to as a "mud motor") in the BHA in order to disintegrate the rock formation to drill the wellbore. As drilling progresses from a soft formation, such as shale, to a hard formation, such as sand, the rate of penetration (ROP) of the drill bit changes, thereby causing wear and tear on portions of the drill bit. In an example, polycrystalline diamond compact (PDC) cutters may be subject to wear and tear when cutting hard formation regions, thereby requiring servicing or replacement of the drill bit. Replacement of the drill bit may be time and cost intensive, as the drill string is pulled from the borehole to remove the bit.

SUMMARY OF THE DISCLOSURE

In an aspect, drill bit for use in drilling a borehole is provided that includes a body including a side section and a face section and a passage in the body. The drill bit further includes a rubbing member disposed in the face section and configured to control a depth of cut for the drill bit, wherein the rubbing member comprises a thermally responsive material in thermal communication with the passage configured to control a position of the rubbing member with respect to the face section.

In another aspect, a method for drilling a borehole in a formation is provided that includes disposing a drill bit in a formation, wherein the drill bit includes a body with a side section, a face section and a passage in the body. The method also includes controlling a position of a rubbing member disposed in the face section by controlling a flow of fluid in the passage, wherein the rubbing member includes a thermally responsive material in thermal communication with the passage and wherein the a shape of the thermally responsive material controls a depth of cut for the drill bit.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters generally designate like or similar elements throughout the several figures of the drawing and wherein.

DESCRIPTION OF THE EMBODIMENTS

Figure 1:
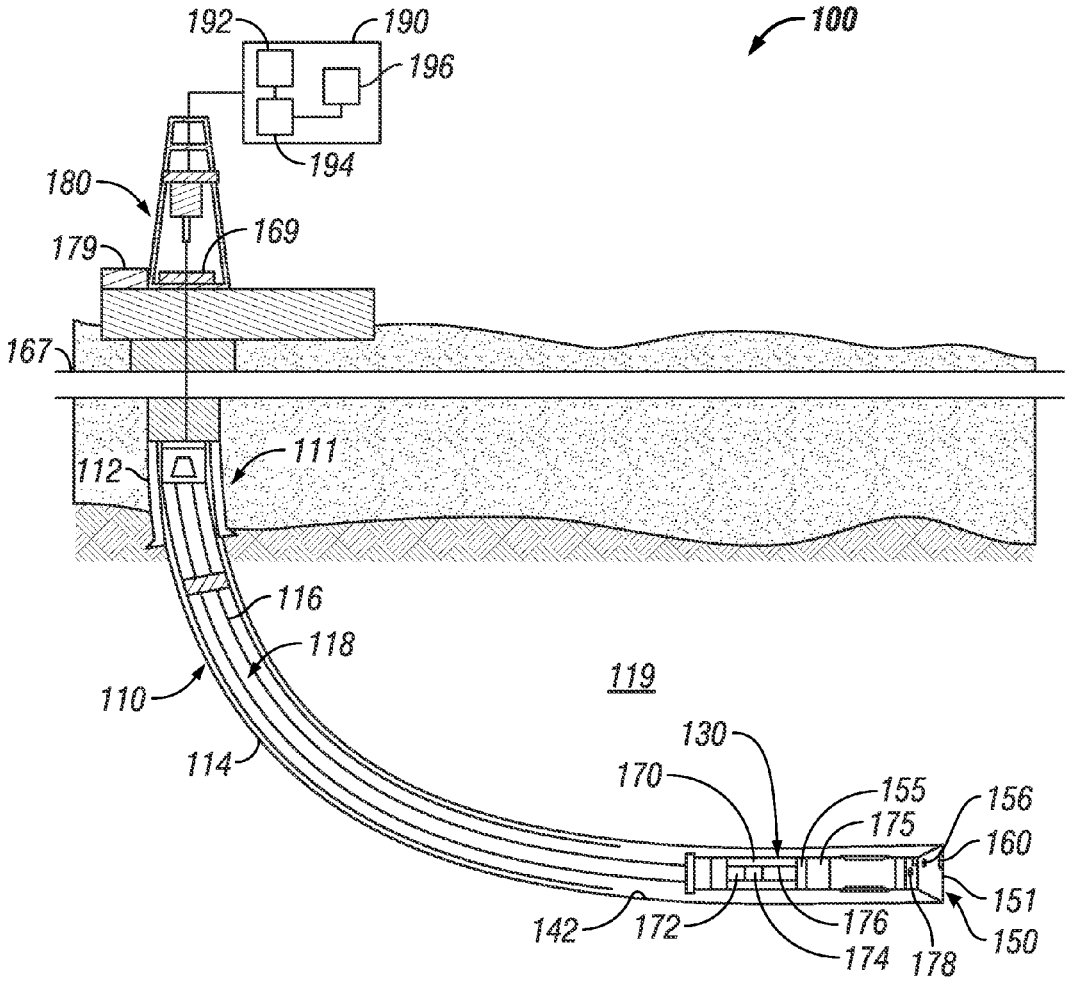
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 thereby forming the wellbore 110 of a selected diameter. Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit by the drill string 118.

A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid 179 discharges at the bottom of the drill bit 150 and returns to the surface 167 via the annular space (also referred as the "annulus") between the drill string 118 and the inside wall 142 of the wellbore 110.

Still referring to FIG. 1, the drill bit 150 includes a face section (or bottom section) 151. The face section 151 or a portion thereof, faces the formation in front of the drill bit or the wellbore bottom during drilling. The drill bit 150, in one aspect, includes one or rubbing members 160 (also referred to as "wear blocks") at the face section 152 that may be adjustably (also referred to as "selectably" or "controllably") extended and retracted from the face section 151 during drilling to control a depth of cut. The rubbing members 160 are also referred to herein as the "rubbing blocks" or "members." A suitable actuation device (or actuation unit) 156 in the BHA 130 and/or in the drill bit 150 may be utilized to activate the rubbing members 160 during drilling of the wellbore 110. A suitable sensor 178 provides signals corresponding to the downhole drilling environment that may be used to determine the rubbing members 160 position. The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip.

The BHA 130 may further include a control unit (or controller) 170 configured to control the operation of the rubbing members 160 and for at least partially processing data received from the sensors 175, 178. Controllers, including the controller 170, may include circuits to process the signals from sensors 175 (e.g., amplify and digitize the signals), a processor 172 (such as a microprocessor) to process the digitized signals, a data storage device 174 (such as a solid-state-memory), and a computer program 176.

In one aspect, the actuation unit 156 controls a flow of fluid to alter or change a position of the rubbing member 160 to control the depth of cut and to extend the life of the drill bit 150. Extending the rubbing member 160 extends bit life and the reduced cutter wear by decreasing the cutter exposure to the formation. For the same WOB (weight on bit) and RPM (revolutions per minute) for the drill bit 150, the ROP (rate of penetration) is generally higher when drilling into a soft formation, such as shale, than when drilling into a hard formation, such as sand. Transitioning drilling from a soft formation to a hard formation may cause unwanted wear on cutters because of the decrease in ROP. Controlling the depth of cut when transitioning between formation regions by controlling a position of the rubbing member 160 and thereby reduces wear on the drill bit 150. The structure of the drill bit 150 and rubbing member 160 are described further in reference to FIGS. 2 and 3.

Figure 2:
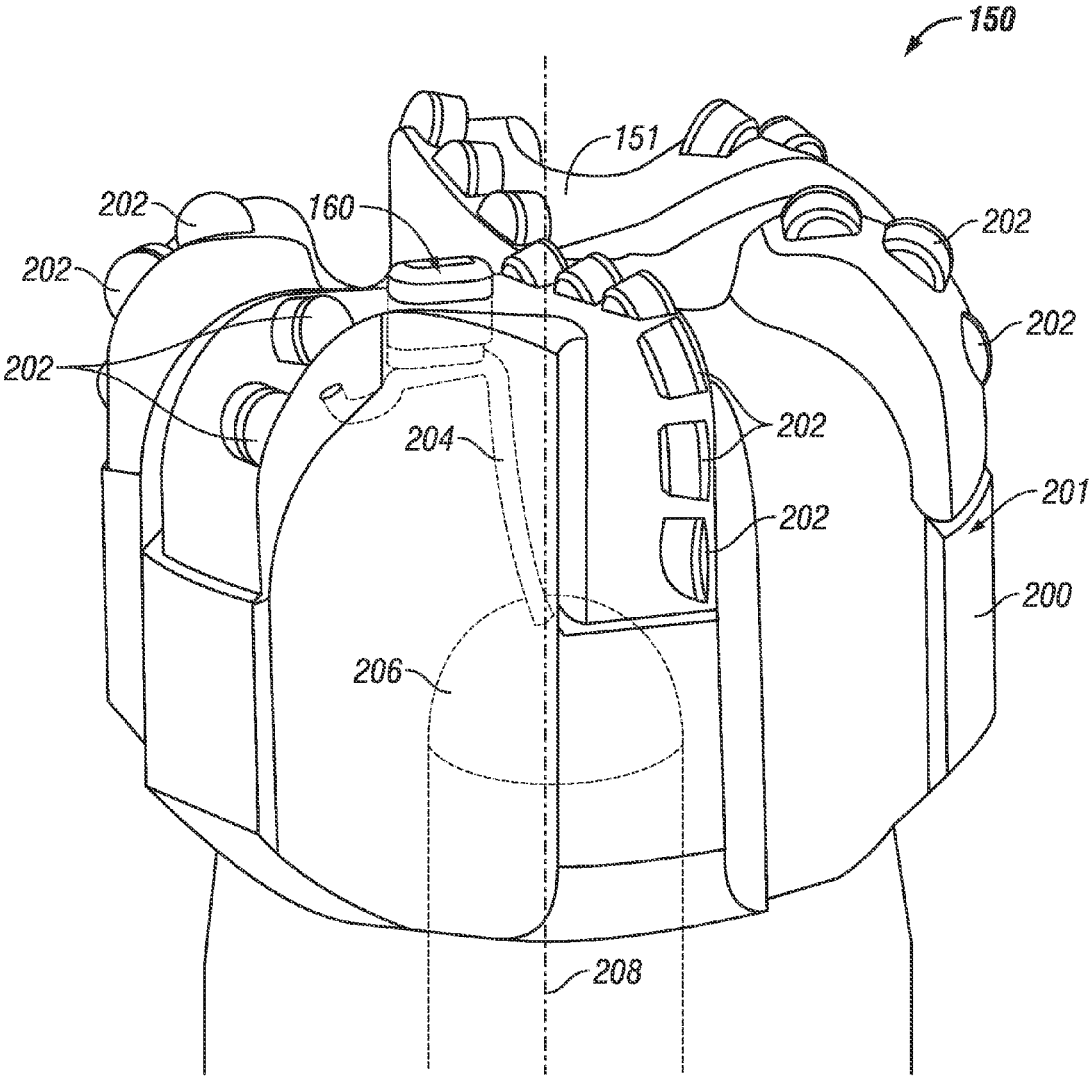
FIG. 2 is a perspective view of an embodiment of the drill bit made according to one embodiment of the disclosure.

FIG. 2 is perspective view of the exemplary drill bit 150 that includes the rubbing member 160 placed on the face section 151 of the bit. The face section 151 and a side section 200 are part of a bit body 201. In an embodiment, cutters 202 are positioned on the face section 151 and side section 200. A passage 204 is located in the bit body 201 and is configured to direct fluid from a cavity 206 proximate the rubbing member 160. In embodiments, a drilling fluid is directed from the cavity 206 through passage 204, wherein the fluid lowers a temperature of the rubbing member 160, thereby controlling a position of the rubbing member 160. The position of the rubbing member 160 includes extending the member or retracting the member with respect to a surface of the face section 151. In an aspect, the rubbing member 160 is configured to extend and retract from the surface of the face section in a direction that is substantially parallel to a bit axis 208. As depicted, the rubbing member 160 is in thermal communication with the passage 204, wherein fluid flow through the passage affects a temperature of the rubbing member 160. In one embodiment, the passage 204 directs the fluid into the wellbore or into the cavity after flowing by the rubbing member 160. In an embodiment, fluid in the passage 204 is in contact with a portion of the rubbing member 160. In another embodiment, a material, such as a membrane that allows thermal communication, is located between the passage 204 and the rubbing member 160.

Figure 3:
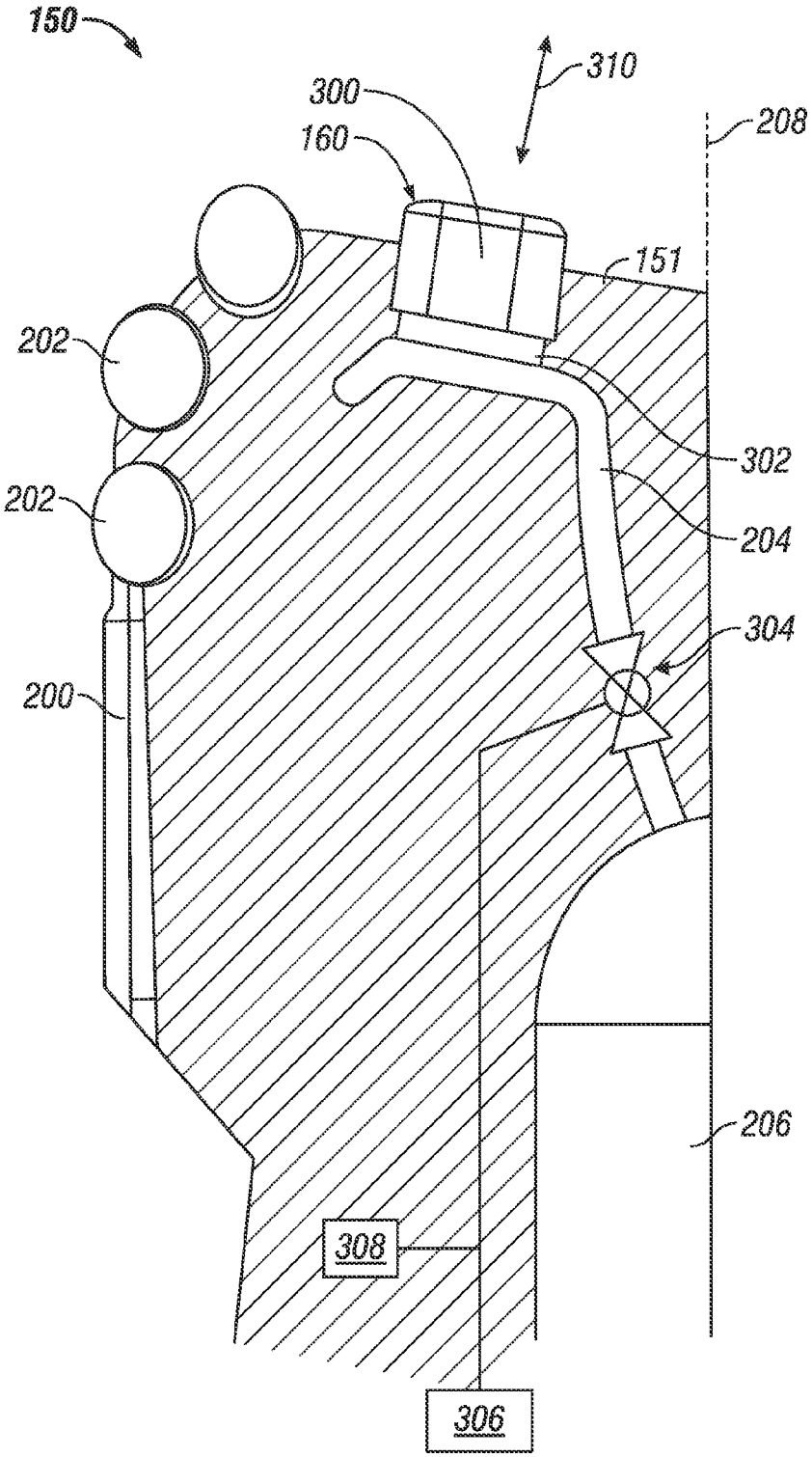
FIG. 3 is a sectional side view of a portion of the drill bit from FIG. 2.

FIG. 3 is a detailed sectional view of a portion of the exemplary drill bit 150. The drill bit 150 shows the rubbing member 160 located on the face section 151, wherein the rubbing member 160 includes a rubbing block 300, and a thermally responsive material 302. As depicted, the thermally responsive material 302 is positioned between the rubbing block 300 and the passage 204 and is configured to expand or contract based on a state of fluid in the passage 204. The passage 204 may have a plurality of states wherein there is cooling fluid, heating fluid and/or no fluid present within the passage 204. In an embodiment, fluid flow through the passage 204 is used to cool the thermally responsive material 302. In the embodiment, the drill bit 150 is heated due to friction with formation during the drilling process, where the drilling fluid cools the bit. The fluid flow is controlled by a flow control device 304 coupled to a suitable controller 306. The controller 306 may be located in the BHA 130 or uphole, as described above. A sensor assembly 308 is coupled to the controller 306 and is configured to measure one or more parameters that are used by the controller 306 to determine a position of the rubbing member 160. For example, the sensor assembly 308 may determine a formation composition and/or vibration, wherein the determined parameters are used by the controller 306 to determine a position for the rubbing member 160 and a resulting depth of cut for the drill bit 150. The flow control device 304 may restrict or stop the flow of fluid through the passage 204 depending on a desired position for the rubbing member 160. In an embodiment, when the flow of fluid is stopped or restricted, the thermally responsive material 302 is heated by the drilling operation being performed by the bit. Heating the thermally responsive material 302 causes it to expand and alter the position of the rubbing member 160 to an extended position. The rubbing member 160 is configured to move in and out of the face section 151, as shown by arrows 310 based on the expansion and contraction of the thermally responsive material 302. The expanded and heated thermally responsive material 302 moves the rubbing member 160 to the extended position to reduce the depth of cut and wear on the bit. Similarly, the contracted and cooled thermally responsive material 302 moves the rubbing member 160 to the retracted position, thereby increasing the depth of cut. In embodiments, the rubbing member 160 may be removed and replaced due to wear, thereby provided an extended life for the drill bit 150. Further, replacing rubbing members 160 may be substantially less expensive than replacing and/or repairing cutters. Exemplary rubbing blocks 300 are made from a suitable durable material, such as tungsten carbide or polycrystalline diamond. In embodiments, the rubbing blocks may be positioned anywhere on the drill bit 150, such as the face 151, side 200 or shank of the bit.

In another embodiment, the flow control device 304 directs a heating or cooling fluid into the passage 204 to control the position of the rubbing member 160. As discussed above, the thermally responsive material 302 expands when heated and contracts when cooled, thereby enabling the flow control device 304 to change a position of the rubbing member 160 based on flow of a heating or cooling fluid in passage 204. To maintain a position of the rubbing member 160, heating, cooling and/or no fluid is flowed into the passage 204, depending on properties of the thermally responsive material 302 and temperatures of the fluid being supplied. The cooling and/or heating fluid may be a "clean" fluid, such as a refrigerant, supplied uphole of the bit 150 or stored within the BHA 130, wherein the fluid may be heated by operation of the bit 150. In addition, the cooling fluid may be insulated from heated portions of the bit during drilling to avoid temperature increases. In other embodiments, the drilling fluid is supplied in passage 204 to heat and/or cool the thermally responsive material 302.

The thermally responsive material 302 is any suitable material configured to expand when heated above a first selected temperature. Embodiments of the thermally responsive material 302 also contract when cooled below a second selected temperature, which may be the same or different than the first selected temperature. In some embodiments, the rubbing member 160 is only configured to change from a retracted position (higher depth of cut) to an extended position (lower depth of cut) one time, wherein the thermally responsive material 302 expands and stays in the expanded position. In other embodiments, the thermally responsive material 302 is configured to expand and contract based on the temperature of the material a plurality of times.

In aspects, the thermally responsive material 302 may include any material capable of withstanding downhole conditions without experiencing degradation. In non-limiting embodiments, such material may be prepared from a thermoplastic or thermoset medium. This medium may contain a number of additives and/or other formulation components that alter or modify the properties of the resulting thermally responsive material 302. For example, in some non-limiting embodiments the thermally responsive material 302 may include metallic material with a high coefficient of thermal expansion. Non-limiting examples include a thermally responsive alloy or metallic material, such as copper, bronze, brass, aluminum, lead, steel alloys, or other suitable metal. In other embodiments, the thermally responsive material 302 includes thermoplastic or thermoset in nature, and may be selected from a group consisting of polyurethanes, polystyrenes, polyethylenes, epoxies, rubbers, fluoroelastomers, nitriles, ethylene propylene diene monomers (EPDM), other polymers, combinations thereof, and the like.

In aspects, the thermally responsive material 302 may be described as having a thermally responsive property. As used herein, the term thermally responsive refers to the capacity of the material to be heated above the first selected temperature and to expand from a first contracted position to a second expanded position as it is heated. However, the same material may then be restored to its original shape and size, i.e., the contracted position, by cooling the material, to a second selected temperature. The second selected temperature may be less than about the first selected temperature or may be another temperature, depending on application needs and the material used.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A drill bit for use in drilling a borehole, comprising:

a body including a side portion and a face;

a passage in the body;

a rubbing member disposed in the face of the drill bit configured to control a depth of cut for the drill bit, wherein the rubbing member comprises a thermally-responsive material in thermal communication with a fluid flow contained in the passage, the thermally-responsive material configured to control a position of the rubbing member with respect to the face; and a control valve operated in response to a parameter of interest to control the fluid flow through the passage to control the temperature of the thermally-responsive material.

2. The drill bit of claim 1, wherein heating or cooling the thermally-responsive material causes the position of the rubbing member to change.

3. The drill bit of claim 1, wherein the rubbing member moves in a direction substantially parallel to an axis of the drill bit when the thermally-responsive material changes the position of the rubbing member.

4. The drill bit of claim 1, wherein the rubbing member further comprises a rubbing block and wherein the thermally-responsive material is positioned between the rubbing block and the passage.

5. The drill bit of claim 1, wherein the rubbing block is configured to extend or retract from a surface of the face based on a state of the thermally-responsive material.

6. The drill bit of claim 1, wherein the thermally-responsive material is configured to expand when heated by restricting a flow of fluid through the passage and configured to contract when the flow of fluid through the passage is not restricted to change the position of the rubbing member.

7. The drill bit of claim 1, wherein the thermally-responsive material comprises a shape memory material configured to expand from a first shape to a second shape upon application of heat to the shape memory material.

8. The drill bit of claim 7, wherein the shape memory material expands from the first shape to the second shape upon application of heat to a temperature about equal to or greater than a glass transition temperature of the shape memory material.

9. The drill bit of claim 1, wherein the rubbing member is positioned between an axis of the drill bit and a cutter on the face.

10. An apparatus for use in drilling a wellbore, comprising:

a drilling assembly having a drill bit at an end thereof, the drill bit including a side portion and a face;

a passage in the body;

a rubbing member disposed in the face of the drill bit configured to control a depth of cut for the drill bit, wherein the rubbing member comprises a thermally-responsive material in thermal communication with a fluid flow contained in the passage, the thermally-responsive material configured to control a position of the rubbing member with respect to the face; and a control valve operated in response to a parameter of interest to control the fluid flow through the passage to control the temperature of the thermally-responsive material.

11. The apparatus of claim 10, wherein the thermally-responsive material is configured to expand when heated by restricting a flow of fluid through the passage and configured to contract when the flow of fluid through the passage is not restricted to change the position of the rubbing member.

12. The apparatus of claim 10, wherein the rubbing member further comprises a rubbing block and wherein the thermally-responsive material is positioned between the rubbing block and the passage.

13. The apparatus of claim 10, wherein the thermally-responsive material comprises a shape memory material configured to expand from a first shape to a second shape upon application of heat to the shape memory material.

14. The method of claim 10, wherein the rubbing member is positioned between an axis of the drill bit and a cutter on the face.

15. A method of drilling a wellbore, comprising:

conveying a drilling assembly having a drill bit at an end thereof, the drill bit including a body including a side, a face, a passage in the body, and a rubbing member in the face and configured to control a depth of cut for the drill bit, wherein the rubbing member comprises a thermally-responsive material in thermal communication with a fluid flow contained in the passage, the thermally-responsive material configured to control a position of the rubbing member with respect to the face;

drilling the wellbore with the drill bit; and controlling the fluid flow through the passage to control the temperature of the thermally-responsive material to control a depth of cut of the drill bit via a control valve operated in response to a parameter of interest.

16. The method of claim 15, wherein the rubbing member is configured to move in a direction substantially parallel to an axis of the drill bit when the thermally-responsive material changes the position of the rubbing member.

17. The method of claim 15, wherein the rubbing member further comprises a rubbing block and wherein the thermally-responsive material is positioned between the rubbing block and the passage.

18. The method of claim 15, wherein the thermally-responsive material comprises a shape memory material configured to expand from a first shape to a second shape upon application of heat to the shape memory material by fluid flow through the passage.

19. The method of claim 15, wherein the rubbing member is positioned between an axis of the drill bit and at least one cutter on the face.

* * * * *